US005916103A

United States Patent [19]

Roberts

[11] Patent Number: 5,916,103

[45] Date of Patent: Jun. 29, 1999

[54] INTERCONNECTED ROOFING SHINGLES

[76] Inventor: Jimmie A. Roberts, 1017 S. Milam St., Amarillo, Tex. 79102

[21] Appl. No.: 08/992,586

[22] Filed: Dec. 17, 1997

[51] Int. Cl.[6] ..... E04D 1/26

[52] U.S. Cl. ..... 52/552; 52/105; 52/518; 52/528; 52/545

[58] Field of Search ..... 52/105, 518, 519, 52/528, 543, 545, 546, 551, 552, 555, 554, 557

[56] References Cited

U.S. PATENT DOCUMENTS

| | | | |
|---|---|---|---|
| 1,467,510 | 9/1923 | Smith, Jr. | 52/557 |
| 1,779,694 | 10/1930 | Crary | 52/557 |
| 1,897,139 | 2/1933 | Overbury | 52/557 X |
| 2,045,707 | 6/1936 | Hammersley . | |
| 2,162,886 | 6/1939 | Hamlin | 52/554 X |
| 3,245,192 | 4/1966 | Hilson | 52/518 X |
| 4,848,057 | 7/1989 | MacDonald et al. | 52/557 X |
| 4,920,721 | 5/1990 | Pressutti et al. . | |
| 5,037,685 | 8/1991 | Richards et al. | 52/518 X |
| 5,102,487 | 4/1992 | Lamb . | |
| 5,287,669 | 2/1994 | Hannah et al. | 52/557 X |
| 5,570,556 | 11/1996 | Wagner . | |
| 5,571,596 | 11/1996 | Johnson . | |

FOREIGN PATENT DOCUMENTS

| | | |
|---|---|---|
| 2097036 | 10/1982 | United Kingdom . |

*Primary Examiner*—Carl D. Friedman
*Assistant Examiner*—Kevin D. Wilkens
*Attorney, Agent, or Firm*—Richard C. Litman

[57] ABSTRACT

A continuous length of roofing shingle comprising shingles interconnected with a pair of parallel reinforcing strips impregnated within the shingles, and located in the granular region of the shingles. The individual shingles have two rectangular notches on each end within which the reinforcing strips are aligned. The interconnections permit the bundling and unfolding of sets of three to nine shingles in one bundle without damaging the shingles. A series of preprinted indicia for nailing sites are provided over the impregnated lower reinforcing strip.

20 Claims, 3 Drawing Sheets

INTERCONNECTED ROOFING SHINGLES

BACKGROUND OF THE INVENTION

1. Field of the Invention

The present invention relates to roofing shingles and, more particularly to a combined shingle having a predetermined continuous length, a pair of parallel reinforcement strips impregnated within the upper granular region, and nailing indicia imprinted over the lower reinforcement strip.

2. Description of the Related Art

The related art describes various shingles which can be interconnected, but fails to suggest one continuous integrated shingle with a pair of notches at each end of an individual shingle aligned with a pair of impregnated parallel strips. The relevant art of interest will be discussed in the order of perceived relevance to the present invention.

U.S. Pat. No. 5,570,556 issued on Nov. 5, 1996, to Thomas E. Wagner describes shingles with connectors such as asphalt roofing paper pieces which are alternatively attached in a median position (hinged on the front surface on one edge and hinged on the rear surface on the opposite edge) by either an adhesive, staples or other fasteners, which act as hinges for folding the shingles to form a bundle. Another embodiment describes that the connectors may be impregnated within and made continuous with the base material of the shingles to permit a short cutout on top and a longer cutout on the bottom. The patent is distinguished, because there is no suggestion for aligned notches at each end of a shingle and the requirement for an impregnated reinforcement strip within each notch with a critical clearance.

U.S. Pat. No. 5,571,596 issued on Nov. 5, 1996, to Matthew E. Johnson describes a three-tab composite roofing shingle which has at least four layers starting with a thin bottom talc coating, an asphalt and E-glass fabric layer, a fiberglass mat saturated with asphalt, a top layer of an asphalt and KEVLAR (™) mat, and an optional coating of a thermo-reflective coating. Stone granules are embedded in the upper region above the adhesive asphalt strip within which four nails are positioned. There is no suggestion for interconnecting these rectangular shingles.

U.S. Pat. No. 2,045,707 issued on Jun. 30, 1936, to Wilbur J. Hammersley describes metal shingles with angular ribs which are secured in place on a roof without the use of nails, screws, lumber or any combustible material. The shingles are interlocked with the ends of the roof and the eaves covered by a drop flash. The dissimilar structure of these metal shingles which are connected only during installation distinguish this patent from the present invention.

U.S. Pat. No. 4,920,721 issued on May 1, 1990, to Joseph E. Pressutti et al. describes a V-shaped fiberglass hip shingle with a textured external surface and includes underneath two parallel stiffening members partially running the length and an elastic sealing member at one end. This specialized shingle is not interconnected before installation.

U.S. Pat. No. 5,102,487 issued on Apr. 7, 1992, to Glenn D. Lamb describes a method and apparatus for manufacturing roofing shingles having tabs and cutouts which comprises a cutting cylinder for engaging a membrane and cutting it into continuous strips and discrete roofing shingles. There is no suggestion for interconnecting separate shingles.

U.K. Patent Application No. 2,097,036 published on Oct. 27, 1982, for Richard Seaman describes rolled thermoplastic membrane strips (neoprene, chlorinated polyethylene, polyvinyl chloride) provided at longitudinal intervals with transverse and notched flaps underneath which are secured to the deck by mechanical fasteners as the strip is unrolled. The membrane strips are unrolled in slightly overlapping rows and sealed together by a heating machine. There is no suggestion for interconnecting separate shingle pieces as in the present invention.

U.K. Patent Application No. 1,042,993 published on Sep. 21, 1966, for Joseph Halliwell describes corrugated rectangular shingles molded from asbestos containing polyvinyl chloride and the like to simulate a tiled roof. The lack of any interconnecting elements between shingles for laying down the shingles distinguishes this publication.

None of the above inventions and patents, taken either singularly or in combination, is seen to describe the instant invention as claimed. Thus, a continuous length of shingle solving the aforementioned problems is desired.

SUMMARY OF THE INVENTION

Accordingly, it is a principal object of the invention to provide interconnected roofing shingles with individual shingles combined in sets.

It is another object of the invention to provide interconnected roofing shingles with individual shingles having a pair of rectangular notches at each end.

It is a further object of the invention to provide interconnected roofing shingles with a pair of impregnated parallel strips, wherein each strip is aligned within each notch.

Still another object of the invention is to provide interconnected roofing shingles which minimizes alignment problems between rows.

It is an object of the invention to provide improved elements and arrangements thereof in a continuous length of interconnected shingles for roofing for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
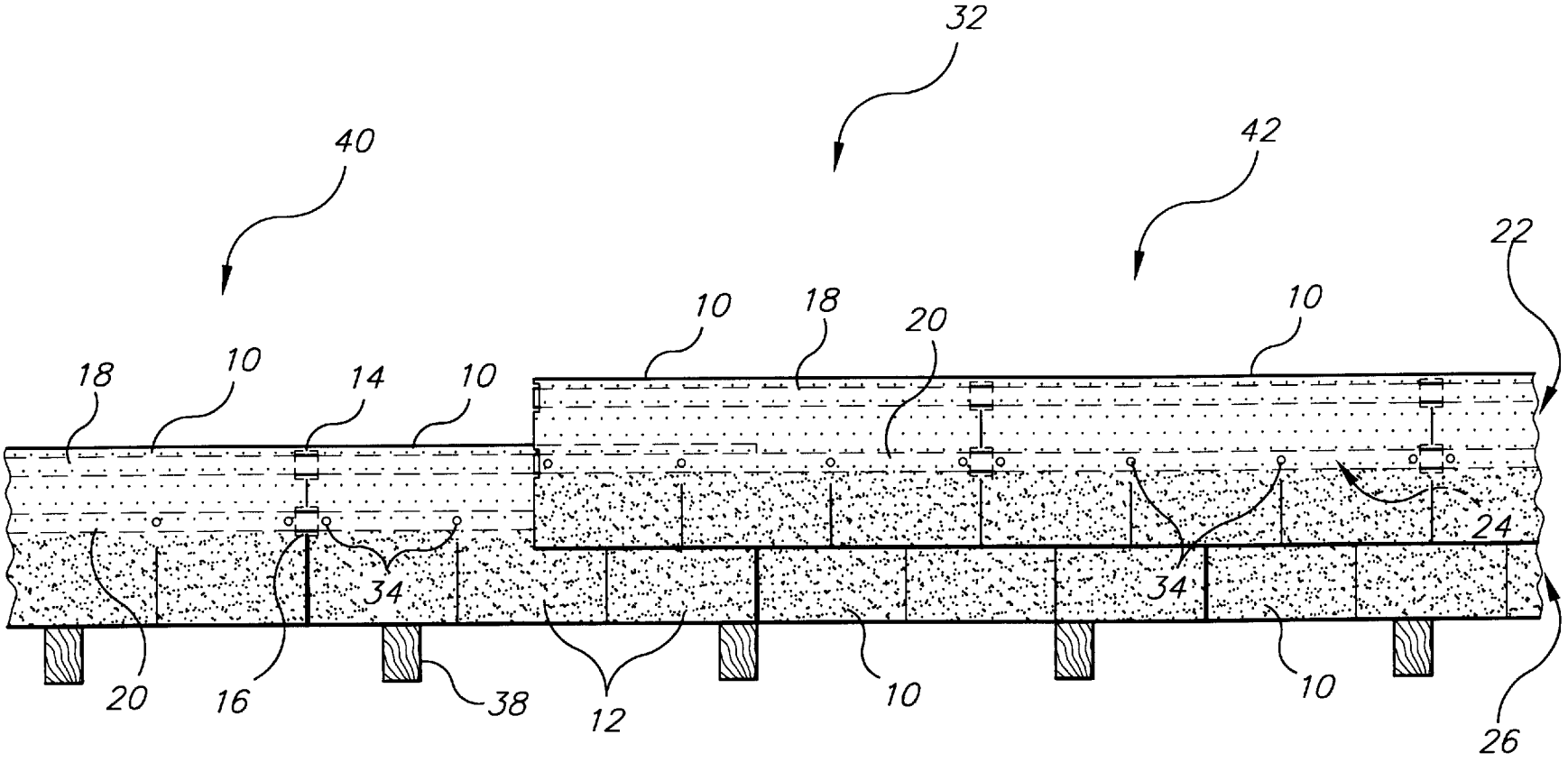
FIG. 1 is a plan view of two partial rows of interconnected shingles on a roof according to the present invention.

The present invention is directed to an interconnected length of sets of asphalt and/or fiberglass shingles which can be bundled and utilized for roofing. Sets of three to nine connected shingles, e.g., rectangular or architectural, which total approximately 9 to 27 ft. in length, can be bundled in approximately 81 ft. long packages. In other words, each package includes up to nine 9 foot sets (or lengths) or three 27 foot sets (or lengths). A bundle will be stacked with shingles face to face and back to back and alternating in the bundle. In the shingling process, a set (or length) of shingles from a bundle of sets will be placed in a desired location, the first bottom shingle will be nailed down and the remaining portion of the 9 to 27 ft. of shingles will be pulled out to expose the full length, aligned and nailed. The process is repeated until the bundle is depleted.

Figure 2:
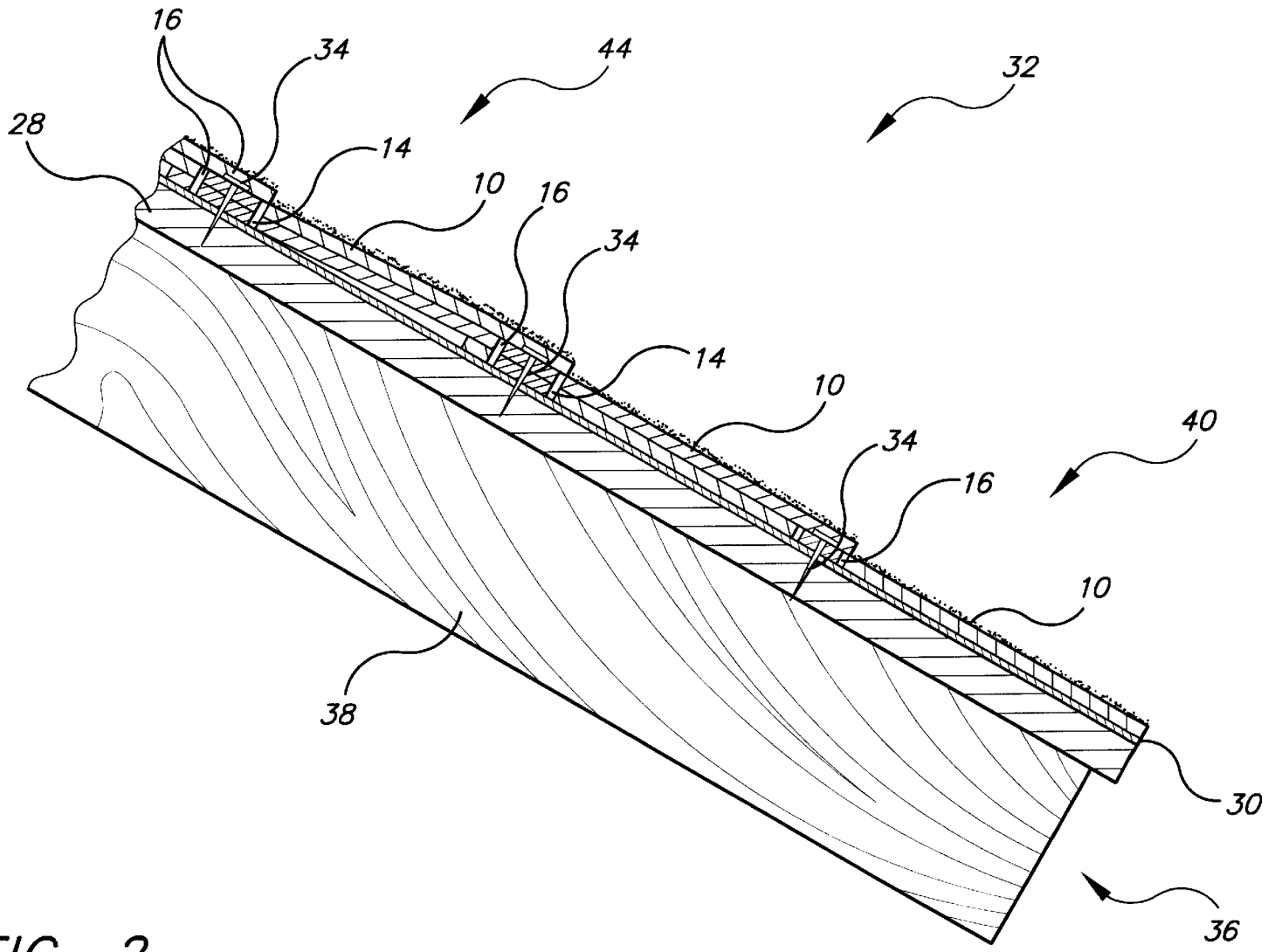
FIG. 2 is a sectional side view of three rows of interconnected shingles fastened on a roof.

In FIGS. 1 and 2, a rectangular shingle 10 with three exemplary tabs 12 has aligned at each end an upper notch 14 and a lower notch 16 which are rectangularly shaped. Aligned over and within the notches 14 and 16 are an upper reinforcement strip 18 and a lower reinforcement strip 20, respectively, which are impregnated within the upper granular region 22 of each shingle 10 during the manufacture of the shingle. Each shingle has in addition to the upper granular region 22, a contiguous tarry median strip region 24 and a lower granular region 26 (usually colored) which includes the tabs 12.

The shingles are fastened to the roof decking 28 over the conventional roof sheathing sheets 30 on the roof 32 with nails or staples 34 by starting from one side edge at the eave 36 over rafters 38 with an aforementioned bundle of sets of interconnected shingles to form a first row 40. Four nails or staples 34 are located on the shingles 10 aided by preprinted indicia over the lower reinforcement strip 20. As the first set of interconnected shingles from a bundle is unfolded and nailed or stapled down, it can be seen that linear alignment of each shingle 10 is automatic, the fastening down time is decreased, and a more secure fastening without exposure of any fasteners when the next line of shingles are fastened in a straight line is provided.

As shown by FIGS. 1 and 2, the second row 42 of shingles 10 is fastened by placing the fasteners 34 into the lower reinforcement strip 20 and into the upper reinforcement strip 18 of the underlying first row 40 of shingles. The alignment times of the third row 44 (FIG. 2) over the second row 42 and the second row over the first row 40 (FIG. 1) is significantly shortened, and as well, the accuracy of placement of the rows 40, 42 and 44 is enhanced.

A critical feature of the present invention is to have an adequate clearance between the reinforcing strips 18, 20 and the corresponding notches 14, 16 on the shingle 10 to permit the folding and unfolding of the shingles without damage. This clearance or gap has been found to be at least 0.125 in. on each side of the reinforcing strip. The notch can have exemplary dimensions of an inset of 0.25 in. and a length of 1.75 in. which allow also for the variation in thickness of differently configured shingles. The thickness of the shingles must be considered for predetermining the aforementioned clearance or gap. The reinforcing strips 18, 20 can have an exemplary width of 1.5 in. and can be fiberglass or comparable material. It should be noted that it is within the ambit of the present invention to insert non-sticking sheets between folded and stacked shingles to prevent shingles from adhering to each other in the sets and bundles.

Figure 3A:
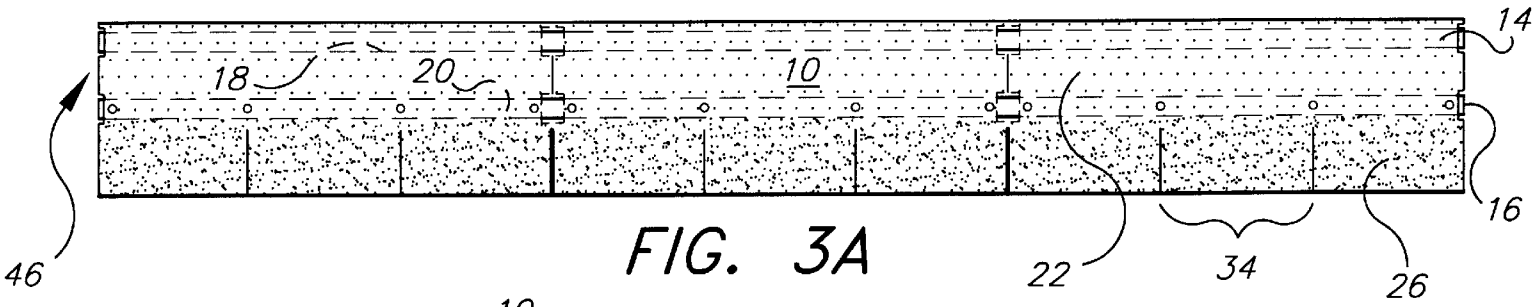
FIG. 3A is a plan view of a set of 3 connected shingles measuring a length of 9 feet.
Figure 3C:
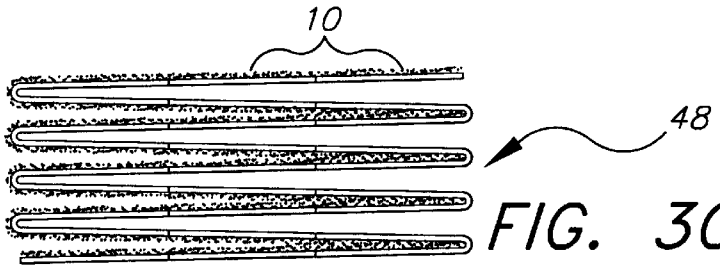
FIG. 3C is a side elevational view of a bundle of 3 shingle sets containing 9 sets or layers measuring a length of 81 feet.
Figure 3B:
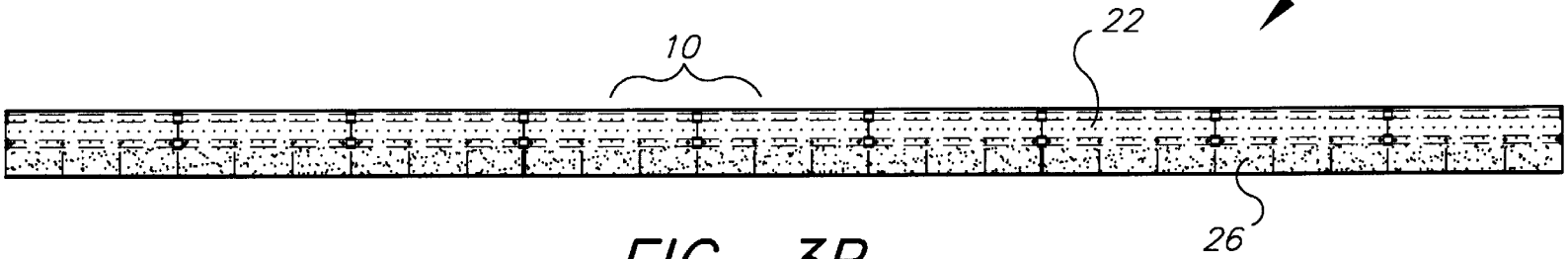
FIG. 3B is plan view of a set of 9 connected shingles measuring a length of 27 feet.
Figure 3D:
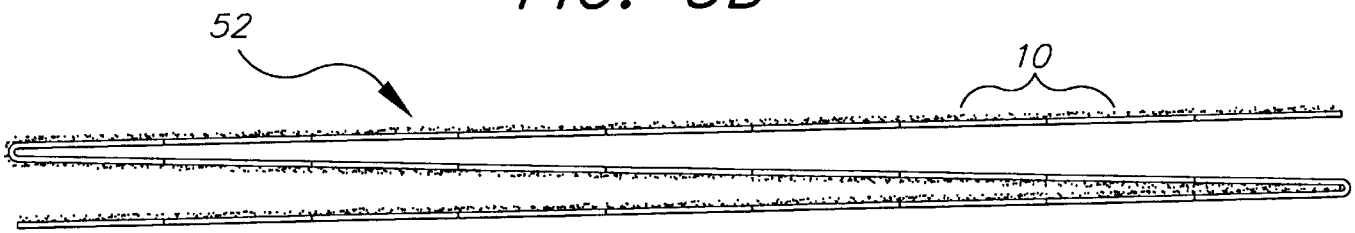
FIG. 3D is a side elevational view of a bundle of 9 shingle sets containing 3 sets or layers measuring a length of 81 feet.

FIG. 3A is a plan view of a set 46 of 3 connected shingles 10 measuring a length of 9 feet. FIG. 3B is plan view of a set 50 of 9 connected shingles 10 measuring a length of 27 feet. FIG. 3C is a side elevational view of a bundle 48 of 3 shingle sets containing 9 sets or layers measuring a length of 81 feet. FIG. 3D is a side elevational view of a bundle 52 of 9 shingle sets containing 3 sets or layers measuring a length of 81 feet.

It is to be understood that the present invention is not limited to the embodiment described above, but encompasses any and all embodiments within the scope of the following claims.

I claim:

1. An interconnected length of roofing shingles comprising:

a plurality of standard sized shingles, each said shingle having an upper granular region, a tarry median strip region and a colored lower granular region;

each shingle having an upper rectangular notch and a lower rectangular notch at each end in said upper granular region;

an upper and a lower reinforcement strip impregnated within said shingles and aligned within said upper and lower notches connecting said plurality of shingles to form a series;

said upper reinforcement strip predetermined for alignment of fasteners on an overlying row of shingles; and said lower reinforcement strip predetermined for alignment of fasteners for said plurality of shingles for attachment to a roof surface;

whereby said plurality of shingles connected with said upper and lower reinforcement strips can be pre-folded over back-to-back and face-to-face for bundling.

2. The interconnected shingles according to claim 1, each of said plurality of shingles being rectangular in shape.

3. The interconnected shingles according to claim 1, each said notch being inset approximately 0.25 inch from each end.

4. The interconnected shingles according to claim 1, each said notch being approximately 1.75 inches in length.

5. The interconnected shingles according to claim 1, each reinforcement strip being fabricated from fiberglass.

6. The interconnected shingles according to claim 1, each reinforcement strip being impregnated within said shingles during manufacture of said shingles.

7. The interconnected shingles according to claim 1, each reinforcement strip having a width providing a gap between said reinforcement strip and said notch of at least 0.125 inch on each side of said reinforcement strip.

8. The interconnected shingles according to claim 1, each reinforcement strip having a width of approximately 1.5 inches.

9. The interconnected shingles according to claim 1, including a nailing pattern imprinted over each of said lower reinforcement strips.

10. A bundle of interconnected and folded roofing shingles comprising:

a plurality of standard sized shingles, each shingle having an upper granular region, a tarry median strip region and a colored lower granular region;

each shingle having an upper rectangular notch and a lower rectangular notch at each end in said upper granular region;

an upper and a lower reinforcement strip impregnated within said shingles and aligned within said upper and lower notches, respectively, connecting said plurality of shingles to form a series;

said upper reinforcement strip arranged in a predetermined fashion for alignment of fasteners on an overlying row of shingles;

said lower reinforcement strip including means for alignment of fasteners for said plurality of shingles for attachment to a roof surface; and said plurality of shingles being bundled with said upper and lower reinforcement strips for folding over back-to-back and face-to-face.

11. The bundle of shingles according to claim 10, a set of at least three shingles being connected and being packaged in a group of nine sets for a bundle.

12. The bundle of shingles according to claim 10, a set of nine shingles being connected and being packaged in a group of three sets for a bundle.

13. The bundle of shingles according to claim 10, each of said plurality of shingles being rectangular in shape.

14. The bundle of shingles according to claim 10, each notch being inset approximately 0.25 inch from each end.

15. The bundle of shingles according to claim 10, each notch being approximately 1.75 inches in length.

16. The bundle of shingles according to claim 10, each reinforcement strip being fiberglass.

17. The bundle of shingles according to claim 10, each reinforcement strip being impregnated within said shingles by the manufacturer of said shingles.

18. The bundle of shingles according to claim 10, each reinforcement strip having a width providing a gap between said reinforcement strip and said notch of at least 0.125 inch on each side of said reinforcement strip.

19. The bundle of shingles according to claim 10, each reinforcement strip having a width of approximately 1.5 inches.

20. The bundle of shingles according to claim 10, wherein said means for alignment of fasteners including a nailing pattern imprinted over each of said lower reinforcement strips.

* * * * *